US009296533B1

(12) United States Patent
Morris

(10) Patent No.: US 9,296,533 B1
(45) Date of Patent: Mar. 29, 2016

(54) BIASED SLIDE LOCK

(71) Applicant: Glenn H. Morris, Chattanooga, TN (US)

(72) Inventor: Glenn H. Morris, Chattanooga, TN (US)

( * ) Notice: Subject to any disclaimer, the term of this patent is extended or adjusted under 35 U.S.C. 154(b) by 0 days.

(21) Appl. No.: 14/595,577

(22) Filed: Jan. 13, 2015

Related U.S. Application Data

(63) Continuation-in-part of application No. 61/937,280, filed on Feb. 7, 2014.

(51) Int. Cl.

| | |
|---|---|
| ***B65D 55/02*** | (2006.01) |
| ***B65D 43/22*** | (2006.01) |
| ***B65D 55/04*** | (2006.01) |
| ***B65D 43/16*** | (2006.01) |
| ***B65D 43/20*** | (2006.01) |

(52) U.S. Cl.
CPC ..... *B65D 55/02* (2013.01); *B65D 43/16* (2013.01); *B65D 43/20* (2013.01); *B65D 43/22* (2013.01); *B65D 55/04* (2013.01)

(58) Field of Classification Search
CPC ..... B65D 55/02; B65D 43/20; B65D 43/22; B65D 43/16; B65D 55/04; B65D 45/28
USPC ..... 220/323, 315, 326, 324, 812, 811, 810, 220/827
See application file for complete search history.

(56) References Cited

U.S. PATENT DOCUMENTS 5,617,968 A * 4/1997 Luburic ..... B65D 43/0256 220/266
2014/0042166 A1* 2/2014 Kodama ..... A45C 13/16 220/350

OTHER PUBLICATIONS

Google Patent Search, "Sliding Armrest", Oct. 21, 2015, p. 1.*

* cited by examiner

*Primary Examiner* — Robert J Hicks
(74) *Attorney, Agent, or Firm* — Miller & Martin PLLC; Stephen J. Stark

(57) ABSTRACT

A biased sliding lock for use with containers provides a locking mechanism to lock the lid relative to a pail. The bias can be overcome to place the container in an unlocked configuration allowing the lid to be rotated relative to the pail. The locking mechanism preferably includes a slide with a leg which may cooperate with a leg of the pail to prevent rotation of the lid relative to the pail in the locked configuration. The legs may have angled surfaces to facilitate closing directly into the locked configuration for at least some embodiments.

12 Claims, 3 Drawing Sheets

BIASED SLIDE LOCK

CLAIM OF PRIORITY

This application claims the benefit of U.S. Provisional Patent Application No. 61/937,280 filed Feb. 7, 2014, which is incorporated by reference herein in its entirety.

FIELD OF THE INVENTION

The present invention relates to a biased locking wrench and more preferably, a biased locking wrench for use in locking pail configurations such as rectangular pails having a planar front face.

BACKGROUND OF THE INVENTION

Rectangular pails such as those shown in U.S. Pat. No. 5,617,968, incorporated herein by reference, by competitor Ropek as well as the applicant's co-pending application Ser. No. 14/014,553 filed Aug. 30, 2013 also incorporated herein by reference, provide for rectangular style pails with locking lids. These prior art designs accomplish some desired objectives. However, the applicant believes there is a need to be able to open pails in an easier fashion, such as preferably from above such as if one is leaning over a pail on the ground. Accordingly, an improved locking system is believed to be desirable for use with such pails.

SUMMARY OF THE INVENTION

Accordingly, it is an object of many embodiments of the present invention to provide an improved pail construction of a container with a locking lid having an improved locking mechanism.

Specifically, for many embodiments of the present invention, a locking mechanism includes a first sliding member which is preferably operably coupled and connected to the lid. The first sliding member is preferably biased into the locked configuration. By overcoming the bias of the spring, the slide is moved to disengage a stop connected the container so that the lid can then be moved upwardly and away from the pail.

Upon closing the lid relative to the pail, the user has two choices. The user can either slide the slide to the unlocked position where it was moved when unlocking the slide from the stop, shut the lid relative to the container and then release the slide to allow it to translate into the locked configuration by the biasing spring. Alternatively, the user can shut the lid on the pail whereby the slide provides a foot which cooperates with a foot of the stop on the pail whereby the two feet push against one another with at least one of which being resilient enough to allow the passage of the two feet (one outward and/or one inward) wherein they then overlap in the locked configuration to prevent someone from pulling them apart.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
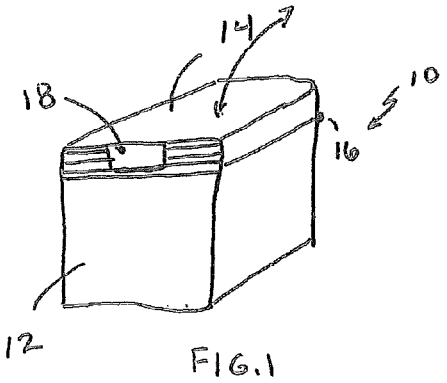
FIG. 1 shows a perspective view of a presently preferred embodiment of a pail having a lock of a first preferred embodiment.

FIG. 1 shows a pail 10 having a container 12 with a lid 14 which is preferably hingedly connected such as at pivot 16. A lock assembly or a lock 18 is shown locking the lid in a shut configuration relative to container 12. This style pail 10 is often referenced to in the art as a rectangular pail.

Figure 2:
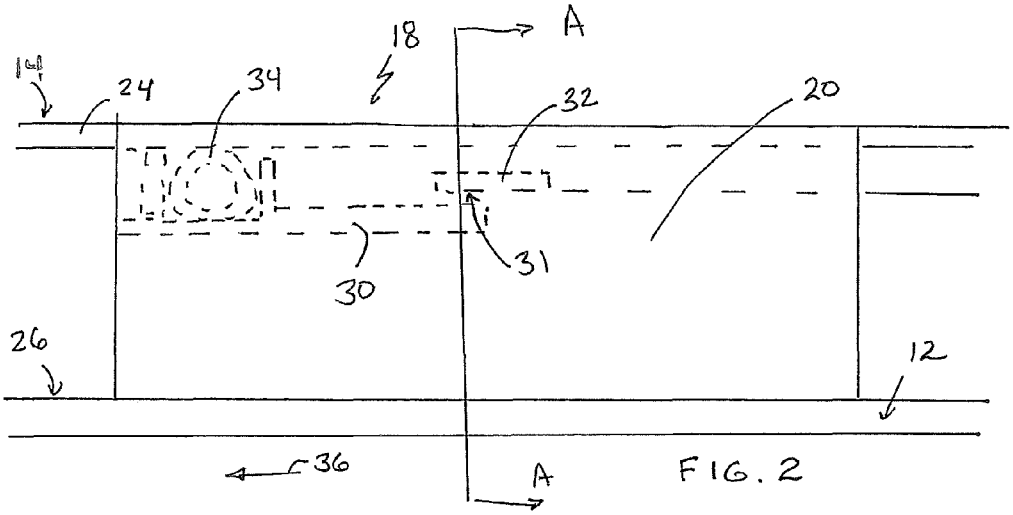
FIG. 2 is a front plan view of the lock shown in FIG. 1 with obscured portions shown in phantom.

FIG. 2 shows a detailed view of the locking mechanism 18 shown in FIG. 1. Specifically, a slide 20 is provided which is at least operable coupled to the lid 14 such as operably coupled to rail 24 of the lid 14 to preferably slide along the rail 24 possibly while being retained to it in an interlocking (or overlapping manner) as illustrated. Possibly, slide 20 is at least partially retained in a slot 26 of the pail 12 to slide in the slot 26 linearly for many embodiments. Locking portions are shown in phantom in this figure.

Slot 26 is preferably formed between upwardly extending arms 11 and 13 of the pail 12. First upwardly extending arm 11 can assist in preventing slide 20 from outward displacement beyond a desired amount (such as to facilitate locking as discussed below) as well as provide a track, such as parallel to the rail 24 to facilitate sliding of the slide 20 between locked and unlocked configurations. First and second upwardly extending arms 11, 13 may be connected by shoulder 15 for at least some embodiments, so as to define slot 26 there between.

Slide 20 preferably provides first foot 30 at a rear of the slide 20 which engages a second foot 32 extending cantileveredly away from the container 12 in the locked configuration. The feet 30,32 overlap elevationally at overlap 31 in the locked configuration as shown in FIG. 2. The lid 14 cannot be lifted relative to container 12 without disengaging the feet 30,32 when in a locked configuration as they interfere with upward movement when in this configuration.

Figure 4:
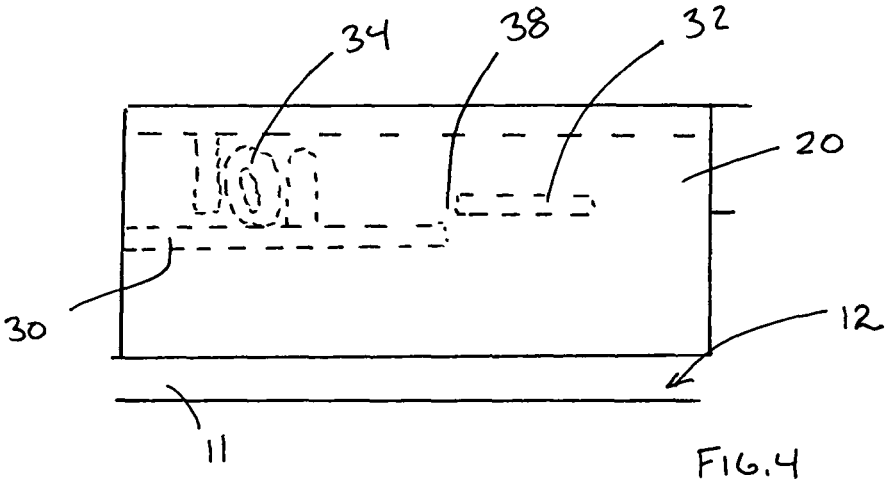
FIG. 4 shows the front plan view shown in FIG. 2 with the slide slid to the left to disengage the lock to allow for opening of the lid relative to the pail.

As can be seen from FIGS. 1 and 2, spring member 34 preferably biases the slide 20 into the locked configuration. Accordingly, the bias of spring member 34 must be overcome by moving the slide 20 in the direction 36 shown to thereby apply sufficient resistance against the bias of the spring member 34 such as to compress it as is shown in FIG. 4 thereby allowing the first foot 30 to be moved linearly to disengage second foot 32 to provide at least a separation 38 therebetween. Other spring members 34 may operate differently. When the separation 38 is provided in the unlocked configuration, the slide 20 along with the lid 14 may be moved upwardly relative to the container 12 with the feet 30,32 disengaged. The lid 14, relative to container 12, is now in the unlocked configuration. Rotation about the pivot 16 can now occur as would be understood by those of ordinary skill in the art. Other opening mechanisms may be provided with various embodiments.

In order to close the lid 14 relative to the containers 12, the exact opposite procedure could occur, namely, the slide 20 could be slid to create the separation 38 as the lid 14 is directed down on top of container 12 and then released so that the spring 34 could then return the slide 20 to the locked configuration shown as FIG. 2 (or an operator could also affect the desired movement).

Figure 3:
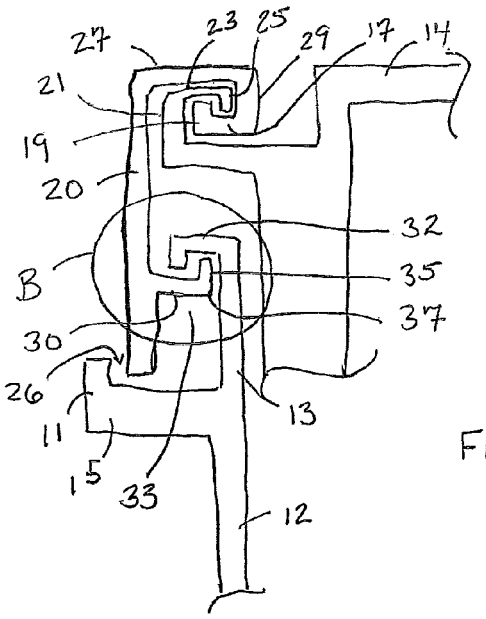
FIG. 3 shows a cross sectional view taken along line A-A of FIG. 2.

FIG. 3 shows the feet 30,32 engaged in the locked configuration. Feet 30,32 may have supports 33 connected to toes 35, or other constructions, at elbows 37 which could be angled and/or curved. Supports 33 are shown extending horizontally and toes 35 vertically. Toe 33 of one leg (such as 30 or 32) cannot pass past support 33 of the other leg 30,32 in the locked configuration. Supports 33 may not pass by one another in the locked configuration either.

Slide 20 may connect to rail 24 in a somewhat similar manner (for at least some embodiments) such as shown in FIG. 3, or other construction. Rail 24 has vertical support 21 connected to horizontal support 23 and downwardly extending lip 25. Meanwhile, slide 20 may have horizontal leg 27, downward leg 29 and upward lip 19 connected to downward leg by inward leg 17. Not all of these parts are required for every embodiment, in fact other embodiments may have different constructions. Slide 20 is shown interlocking with rail 24 in the illustrated embodiment to allow movement of the slide 20 along the rail 24, but not away from it, in the preferred embodiment.

Figure 5:
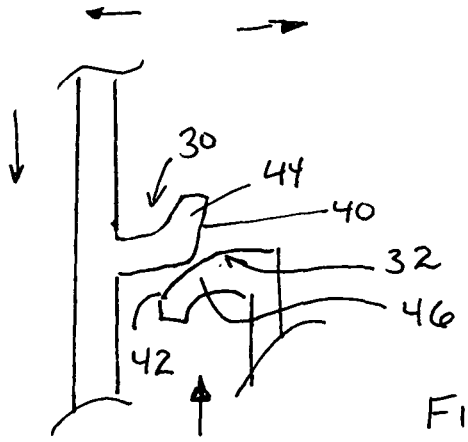
FIG. 5 shows detail B from FIG. 3 showing an ability to close and lock the pail with the slide and the lock configuration such as shown in FIG. 2.

However, there is preferably also another way of closing the lid. Specifically, the first and second feet 30,32 as shown in better detail in FIG. 5 are provided with at least one curved and/or otherwise angled surfaces 40,42 so when directed towards each other, at least one of the first or second legs 30,32 deflect so that the arms 44,46 can then at least partially overlap elevationally (possibly with legs 30,32) to provide the locked configuration as shown in FIG. 3. By providing angled surface(s) 40 or 42, the slide 20 and/or container 12 may also at least partially be detached during this procedure, for at least some embodiments.

When pushed past one another in a vertical manner at least one of the legs 30,32 is at least sufficiently resilient so that upon attempting closure of the lid 14 relative to the container 12, the locking action can take place.

Figure 6:
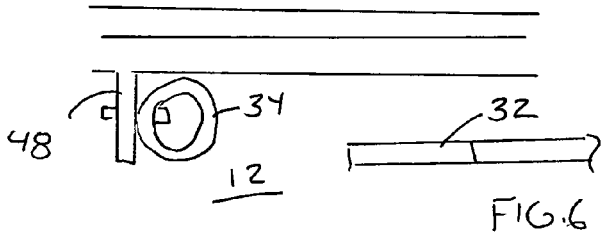
FIG. 6 shows a front plan view with the slide removed.
Figure 7:
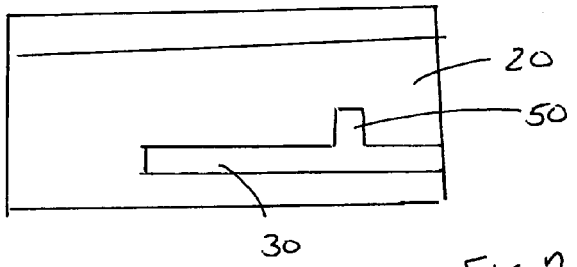
FIG. 7 shows a rear view of the slide of the presently preferred embodiment.

FIG. 6 shows the spring can be connected to a support 48 on the container 12 as above the second leg 32. FIG. 7 shows the slide 20 with the first leg 30 and a stop 50 whereby the spring 34 can be compressed between the support 48 and the stop 50 when transitioning between locked and unlocked configurations as would be understood by those of ordinary skill in the art. Other techniques for locating the spring member 34 can be accomplished as is known in the art.

While this is one preferred embodiment for providing a slide biased lock for use with locking a pail lid to a pail container, there are likely others which employ similar technology to achieve similar results.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A pail comprising:

a container hingedly connected to a lid at a pivot;

a sliding lock assembly, said lock assembly having a slide at least operably coupled to the lid and constrained to slide along a rail of the lid;

said slide having a first foot, and a second foot connected to the container;

whereby when in both a closed configuration and a locked configuration, the first foot and second foot overlap to prevent pivoting of the lid relative to the container to an open configuration from the closed configuration, and when in an unlocked configuration, the first and second feet do not elevationally overlap permitting the lid to be pivoted to the open configuration relative to the container from the closed configuration.

2. The pail of claim 1 further comprising a spring member, said spring member biasing the slide to the locked configuration.

3. The pail of claim 2 wherein the spring member is connected to the lid.

4. The pail of claim 1 further comprising a slot formed in the pail to receive at least a portion of the slide in the locked configuration.

5. The pail of claim 4 wherein the slide moves linearly relative to the slot and rail between the locked and unlocked configurations.

6. The pail of claim 4 wherein a front of the slide is restrained from outward movement by an upwardly extending leg assisting in forming the slot.

7. The pail of claim 1 wherein the slide overlappingly connects to the rail.

8. The pail of claim 1 wherein with the slide directed to a locked and open configuration, one of the first and second foot has at least one of a curved and an angled surface directed toward the other of the first and second foot whereby upon downward movement of the lid relative toward the container toward the closed configuration the one of the first and second feet deflects until in a closed and locked configuration.

9. The pail of claim 8 wherein the one of the first and second feet deflects outwardly away from the pail when contacting the other of the first and second feet.

10. The pail of claim 8 wherein the one of the first and second feet deflects inwardly toward the pail when contacting an other of the first and second feet.

11. The pail of claim 10 wherein the other of the first and second feet deflects outwardly away from the pail.

12. The pail of claim 11 wherein both the first and second feet have at least one curved and angled surfaces directed toward the other foot.

* * * * *